US010135213B2

(12) United States Patent
Brunnbauer et al.

(10) Patent No.: US 10,135,213 B2
(45) Date of Patent: Nov. 20, 2018

(54) WEARABLE SENSOR SYSTEM WITH AN ARTICLE OF CLOTHING AND AN ELECTRONICS MODULE, ARTICLE OF CLOTHING FOR A WEARABLE SENSOR SYSTEM, AND ELECTRONICS MODULE FOR A WEARABLE SENSOR SYSTEM

(71) Applicant: WORKAROUND GMBH, Munich (DE)

(72) Inventors: Konstantin Brunnbauer, Ruderting (DE); Hans Christian Sittig, Freiburg (DE); Paul Guenther, Bad Teinach (DE); Tobias Gutmann, Allershausen (DE); Jonas Girardet, Munich (DE)

(73) Assignee: WORKAROUND GMBH, Munich (DE)

( * ) Notice: Subject to any disclaimer, the term of this patent is extended or adjusted under 35 U.S.C. 154(b) by 0 days.

(21) Appl. No.: 15/597,399

(22) Filed: May 17, 2017

(65) Prior Publication Data

US 2017/0338610 A1 Nov. 23, 2017

(30) Foreign Application Priority Data

May 18, 2016 (DE) ..... 10 2016 109 117

(51) Int. Cl.
*H01R 4/58* (2006.01)
*H01R 33/94* (2006.01)
(Continued)

(52) U.S. Cl.
CPC ..... *H01R 33/94* (2013.01); *A41D 19/0024* (2013.01); *A41D 19/0037* (2013.01);
(Continued)

(58) Field of Classification Search
CPC .... H01R 33/00; H01R 33/94; A41D 19/0024; A41D 19/0037
(Continued)

(56) References Cited

U.S. PATENT DOCUMENTS 5,625,180 A 4/1997 Hanson et al.
8,376,759 B2 * 2/2013 Debock ..... H01R 12/775 439/37
(Continued)

FOREIGN PATENT DOCUMENTS

DE 202013105192 U1 1/2014
DE 102015214331 A1 2/2017
WO 2008/075859 A1 6/2008

*Primary Examiner* — Abdullah Riyami
*Assistant Examiner* — Nader Alhawamdeh
(74) *Attorney, Agent, or Firm* — McNees Wallace & Nurick LLC

(57) ABSTRACT

A wearable sensor system has an article of clothing and an electronics module. The electronics module includes a housing, a circuit board, and a contact element. The article of clothing includes a glove, an operational element, and a holder for attaching the electronics module having a receiving space and a mating contact. The guide being configured such that the contact element performs one of a linear movement and a pivoting movement toward the bottom when moving to the final position with respect to the mating contact. Further, an article of clothing and an electronics module for the wearable sensor system are shown.

19 Claims, 5 Drawing Sheets

(51) Int. Cl.

| | |
|---|---|
| ***A41D 19/00*** | (2006.01) |
| ***H01R 12/71*** | (2011.01) |
| ***H01R 13/631*** | (2006.01) |
| ***H01R 33/97*** | (2006.01) |
| ***H01R 13/24*** | (2006.01) |

(52) U.S. Cl.
CPC ..... *H01R 12/714* (2013.01); *H01R 13/24* (2013.01); *H01R 13/631* (2013.01); *H01R 33/97* (2013.01)

(58) Field of Classification Search
USPC ..... 439/929, 39
See application file for complete search history.

(56) References Cited

U.S. PATENT DOCUMENTS

| | | | | |
|---|---|---|---|---|
| 2014/0194166 | A1* | 7/2014 | Falck ..... | A41D 19/0024 455/567 |
| 2017/0338610 | A1* | 11/2017 | Brunnbauer ..... | H01R 33/94 |
| 2018/0146720 | A1* | 5/2018 | Sittig ..... | A41D 1/002 |

* cited by examiner

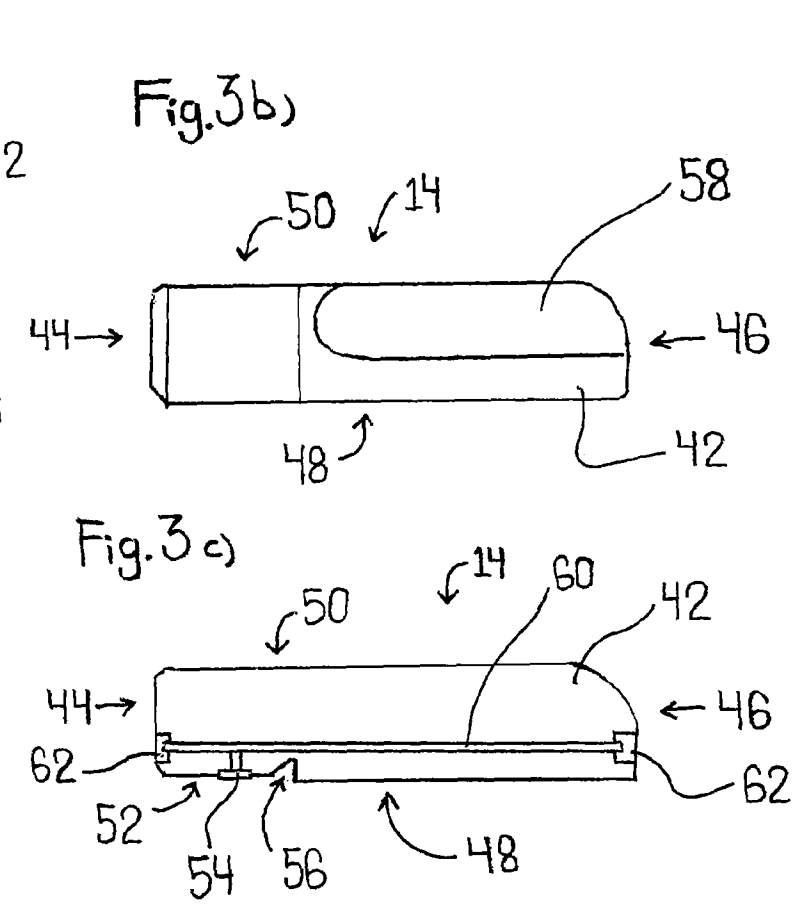
Fig. 3b)
Fig. 3c)
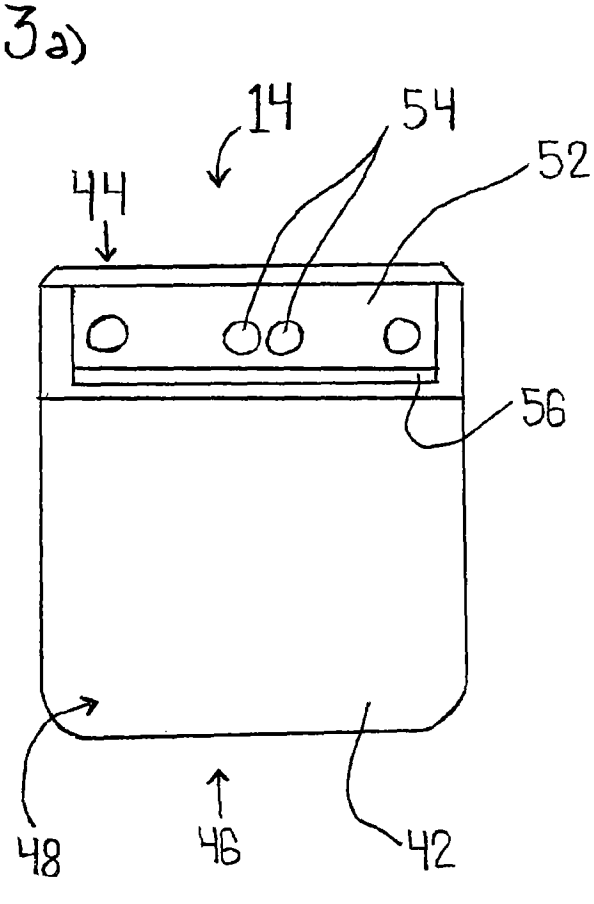
Fig. 3a)

WEARABLE SENSOR SYSTEM WITH AN ARTICLE OF CLOTHING AND AN ELECTRONICS MODULE, ARTICLE OF CLOTHING FOR A WEARABLE SENSOR SYSTEM, AND ELECTRONICS MODULE FOR A WEARABLE SENSOR SYSTEM

FIELD OF THE INVENTION

The present invention relates to a wearable sensor system including an article of clothing and an electronics module, an article of clothing for a wearable sensor system, and an electronics module for a wearable sensor system.

BACKGROUND OF THE INVENTION

Wearable sensor systems typically include an electronics module in which a circuit board having a controller for the sensor system is provided and which may also contain a sensor such as an optical barcode scanner. This electronics module has to be attached to an article of clothing so that it is carried by the user all the time. At the same time, the electronics module is the most costly component of the sensor system.

The article of clothing itself may comprise a glove, and it is further known to provide an operational element on the glove. The operational element may be a switch, for example, which serves as an input device of the electronics module. To this end, the operational element needs to be connected, electrically or in terms of information technology, to the electronics module, more specifically to the circuit board within the electronics module. In addition, the electronics module and the holder need to have as small an overall height as possible in order that the user's hand with the electronics module attached on the glove will not get caught on any objects.

If the glove is a consumable item such as, for example, a work glove of an assembly worker, the glove will be replaced weekly or even daily. Therefore, a firm connection to the expensive electronics module is out of the question since the comparatively expensive electronics module would also need to be frequently replaced then. For this reason, a holder is provided on the glove, so that the electronics module can be repeatably mounted in the holder and thus to the glove without a tool. In this way, the glove can be manufactured cost-effectively as a consumable item, whereas the electronics module needs to be purchased only once.

The wearable sensor system, however, is also exposed to wear here since owing to the frequent exchange of the electronics module, the contact elements of the electronics module that connect the circuit board of the electronics module to the operational element of the article of clothing, and the mating contacts of the retainer will wear down.

It is therefore the object of the invention to provide a wearable sensor system, an article of clothing as well as an electronics module for a wearable sensor system which provide for a reduced wear.

BRIEF SUMMARY OF THE INVENTION

The object is achieved by a wearable sensor system including an article of clothing and an electronics module, wherein the electronics module includes a housing defining a front side, a rear side, a bottom side and a top side of the electronics module, a circuit board provided in the housing, and at least one contact element which is electrically connected to the circuit board and is arranged at least partly on the bottom side, wherein the article of clothing includes a glove, an electric operational element, and a holder attached to the glove for repeatably attaching the electronics module to the glove without a tool, wherein the holder includes a receiving space for receiving the electronics module having an insertion opening and an end in the insertion direction, a bottom delimiting the receiving space with respect to the glove, at least one mating contact electrically connected to the operational element, and a guide, the at least one mating contact being provided at the bottom, wherein the electronics module is adapted to be inserted into the holder of the article of clothing such that the electronics module can assume two positions, the at least one contact element being spaced apart from the holder in the first position, and the at least one mating contact of the holder and the at least one contact element of the electronics module being in contact in the second position, so that the circuit board and the electric operational element are connected for information transfer, in particular electrically, by means of the at least one contact element and the at least one mating contact, and the guide being configured such that when attaching the electronics module to the holder, the electronics module travels along a predefined movement path in which the at least one contact element performs a linear movement or a pivoting movement toward the bottom when moving from the first position to the second position with respect to the at least one mating contact. The linear movement may, in particular, be effected substantially perpendicularly to the bottom here. Also, advantageously, in the first position the at least one mating contact is spaced apart from the bottom side of the electronics module. Apart from a full glove having fingers, a glove here is understood to mean other pieces of handwear as well, such as a finger stall or a finger cot. Further, the glove may be configured in multiple parts. For example, the glove is an elastic and snugly fitting work glove, which, in addition, has to meet occupational safety requirements. For a further extension of the service life of the glove, the glove may be provided with a reinforcement layer on its outer surface in the region of the operational element.

The invention is based on the finding that in order to prevent wear on the contact element of the electronics module and on the mating contact of the retainer, shear forces acting on the contact element and/or on the mating contact and occurring in particular during insertion of the electronics module into the holder have to be avoided.

The guide now prescribes a movement path in which the sensitive contact element and/or the sensitive mating contact of the electronics module initially do not experience any friction and the contact element will not come into contact with the holder or, more precisely, with the mating contact until it moves to the second position, i.e. when the electronics module is finally attached to the holder. In this way, the shear forces acting on the contact element are minimized. In the second, attached position, the electronics module rests against the bottom of the retainer. The mating contact and the contact element may be configured as mechanical, electrical contacts, as an inductive and/or capacitive contact device, or as antennas. Here, the components of the inductive and/or capacitive contact device or the antenna may include a cover for further protection from wear.

In this connection, in addition to mechanical contacts, "being in contact" is understood to mean other types of contacting as well, in particular non-contact types of contacting that allow a transfer of information, such as a contact by means of electromagnetic waves or by measuring changes in physical properties of the contact element and/or of the mating contact.

Preferably, the guide includes at least one deflector which extends from the bottom into the receiving space. The at least one deflector may extend over a large part of the width of the receiving space here and may more particularly be formed as an edge which extends transversely to the insertion direction. The deflector prevents, in a simple and cost-effective manner, the contact elements of the electronics module from coming into contact with the holder prematurely.

For example, the insertion direction runs substantially parallel to the bottom, which allows a particularly flat design of the holder.

In one configuration of the invention, in the second position, the electronics module has snapped into place in the holder, as a result of which a particularly secure and easily releasable connection with the holder is realized.

The object is further achieved by an article of clothing for a wearable sensor system, including a glove, an electric operational element, and a holder attached to the glove for receiving the electronics module, wherein the holder includes a receiving space for receiving the electronics module having an insertion opening and an end in the insertion direction, a guide, a bottom, and at least one mating contact electrically connected to the operational element, wherein the bottom delimits the receiving space with respect to the glove, and the at least one mating contact is provided at the bottom, wherein the guide includes a deflector which extends from the bottom into the receiving space. As described, the deflector protects the contact element of the electronics module and also the mating contact of the holder from wear during insertion.

Preferably, the at least one mating contact is arranged completely below an imaginary plane which is defined by the bottom at the end of the receiving space and the highest point of the deflector as viewed from the glove, which ensures that the bottom side of the electronics module can not prematurely come into contact with the mating contact of the holder and the contact element can not prematurely come into contact with the holder. Apart from the highest point of the deflector, the plane is defined here by a straight line which extends on the bottom at the end of the receiving space, transversely to the insertion direction.

For example, the at least one deflector is arranged between the at least one mating contact and the end of the receiving space in the insertion direction, so that damage to the contact element of the electronics module as caused by the deflector during insertion of the electronics module into the holder is prevented.

In one variant configuration of the invention, the guide includes at least one bracket which defines the receiving space on the top side, i.e. on the side of the receiving space facing away from the glove. The bracket allows the electronics module to be securely held within the holder.

Preferably, the at least one bracket is arranged entirely between the at least one deflector and the end of the receiving space in the insertion direction, as a result of which a simple insertion of the electronics module is ensured.

In a further configuration of the invention, the at least one mating contact is configured as a mechanical, electrical contact which is supported on the bottom and/or spring-mounted in relation to the bottom, as a result of which a reliable contacting between the mating contact and the contact element is ensured, even in the event of vibrations or shocks.

In one configuration of the invention, the holder includes a lever in the region of the insertion opening, for releasing the electronics module from the holder. The lever may be part of the guide here. Also, the lever may extend from the bottom contrary to the insertion direction. The lever simplifies the operation of the wearable sensor system in that the force necessary to release the attachment or snap connection of the electronics module within the holder can be reduced. At the same time, the force by which the electronics module is held within the holder can thereby be increased. This allows a secure attachment, while at the same time, the electronics module is releasable from the holder with one hand.

The object is further achieved by an electronics module for a wearable sensor system, including a housing defining a front side, a rear side, a bottom side and a top side of the electronics module, a circuit board provided in the housing, and at least one contact element which is electrically connected to the circuit board for connecting with at least one mating contact of the holder and which is arranged at least partly on the bottom side, the housing having a recess or a projection that cooperates with the guide of the holder such that when attaching the electronics module to the holder, the electronics module travels along a predefined movement path in which the at least one contact element performs a linear movement or a pivoting movement toward the bottom when moving from the first position to the second position with respect to the at least one mating contact. The bottom side of the electronics module is the side facing the glove when the electronics module is attached to the glove. The rear side of the electronics module is the side which is inserted into the holder first when the electronics module is used as intended. In addition, to facilitate the insertion, the edge between the front and bottom sides may be beveled. Also, the electronics module may comprise a barcode scanner.

Preferably, the recess or the projection is arranged between the contact element and the rear side, so that the contact element does not have to pass the deflector of the article of clothing during insertion.

For example, the recess is configured such that it can receive the deflector of the article of clothing, so that the bottom side of the electronics module can fully rest on the bottom of the holder, which allows an attachment to the holder free of play.

In one configuration of the invention, the recess is a groove that extends transversely to the insertion direction. In this connection, "transversely to the insertion direction" preferably means parallel to the rear side. In this way, manufacturing tolerances of the deflector of the holder can be compensated.

For example, the contact element is offset from the bottom side toward the top side, as a result of which the wear on the contact elements is further reduced. Here, the entire connecting region of the housing around the contact elements may be offset.

In a further embodiment of the invention, the at least one contact element is fixedly connected to the housing and movably connected to the circuit board. Here, the at least one contact element may be a spring contact which resiliently contacts the circuit board, or the contact element is connected to the circuit board by means of a cable. In this way, manufacturing tolerances of the circuit board or of the housing can be compensated, and wear on the electrical connection between the circuit board and the at least one contact element, e.g., in the event of shocks or vibrations, can also be prevented.

In a further configuration of the invention, the housing has at least one indentation which extends from the rear side at least partly on the top side. This indentation may, for example, extend contrary to the insertion direction maximally as far as to the recess. The at least one indentation here cooperates with the bracket of the holder and serves to securely attach the electronics module to the holder.

BRIEF DESCRIPTION OF THE DRAWINGS

Further features and advantages of the invention will be apparent from the description below and from the accompanying drawings, to which reference is made and in which:

FIGS. 3*a* to 3*c* schematically show an electronics module according to the invention in a bottom view, a side view and a longitudinal sectional view, respectively;

DETAILED DESCRIPTION OF THE INVENTION

Figure 1:
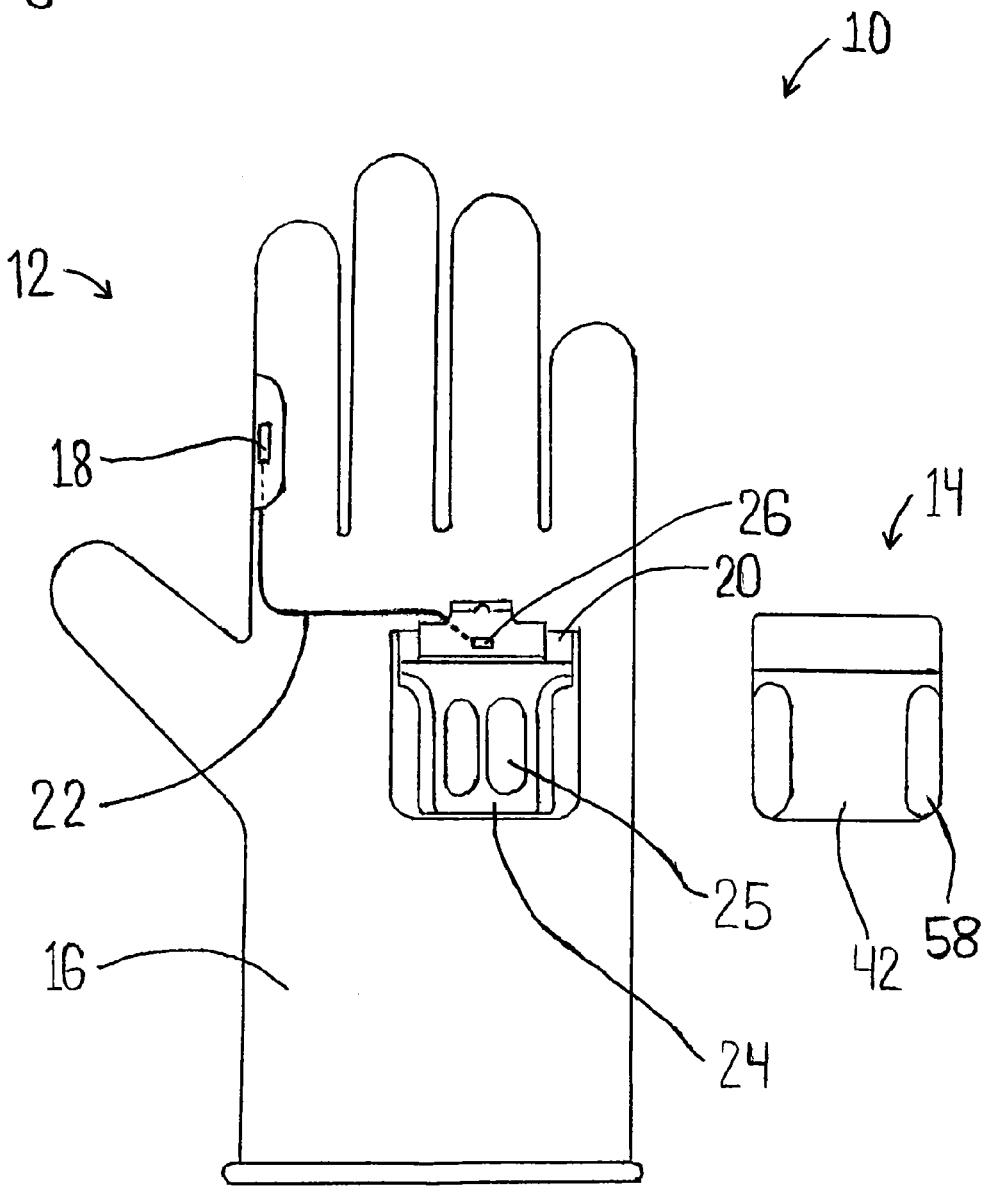
FIG. 1 shows a schematic view of the wearable sensor system according to the invention with an article of clothing according to the invention and an electronics module according to the invention.

FIG. 1 illustrates the wearable sensor system 10 with an article of clothing 12 and an electronics module 14.

The article of clothing 12 includes a glove 16, an electric operational element 18, for example a pushbutton, a holder 20, and a cable 22.

Figure 2A:
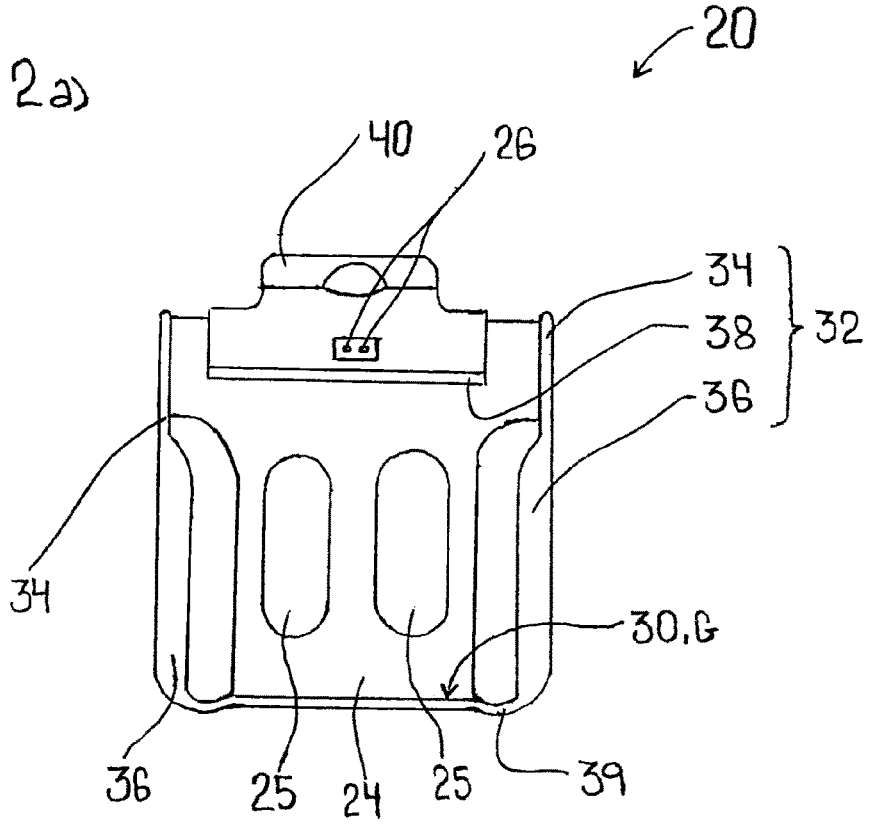
FIGS. 2*a* to 2*c* schematically show a holder of an article of clothing according to the invention in a top view, a side view and a sectional view, respectively.
Figure 2B:
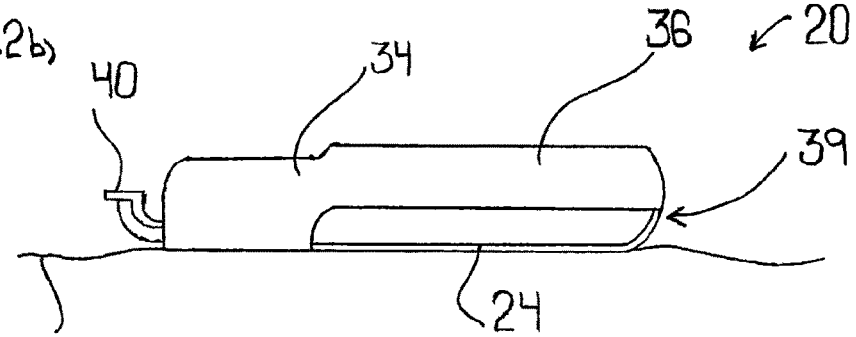
Figure 2C:
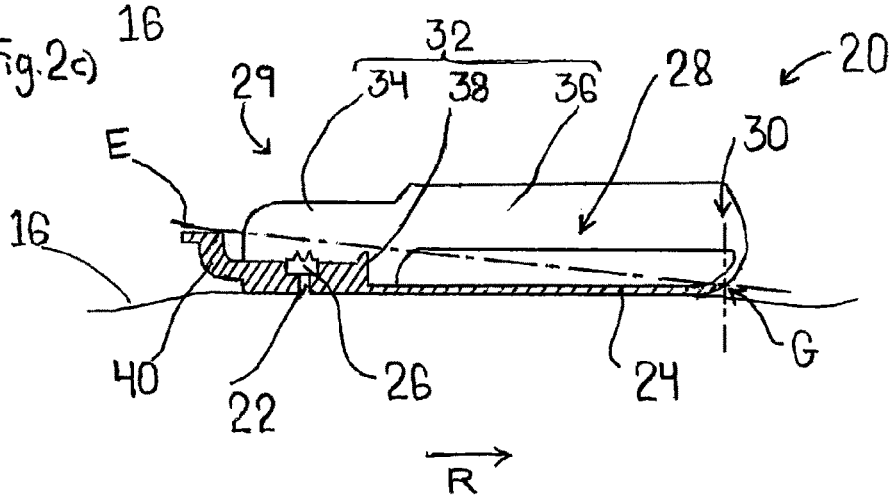

The holder 20 is illustrated in detail in FIGS. 2*a* to 2*c* and has a bottom 24 and two mating contacts 26 which are arranged on the bottom 24. The mating contacts 26 may be spring mounted in relation to the bottom 24 and are, for example, in the form of spring contacts.

The bottom 24 is attached to the glove 16, for example by means of a hot-melt adhesive, so that the entire holder 20 is attached to the glove 16. By way of example, the bottom 24 has openings 25 that serve for an air supply to the hand of the user within the glove 16.

As illustrated in FIG. 1, the cable 22, which may likewise be attached to the glove 16 by means of a hot-melt adhesive, connects the electric operational element 18 to the mating contacts 26 of the holder 20.

The cable 22 may be a commonly used cable. But a cable 22 which is in the form of a flexible circuit board or a foil having conductor tracks printed thereon is also conceivable.

Further, the holder 20 has a receiving space 28 for the electronics module 14, into which the electronics module 14 can be inserted in an insertion direction R. In the embodiment shown, the insertion direction R runs substantially parallel to the bottom. In FIG. 2*a*, the insertion direction runs downward, in FIGS. 2*b* and 2*c* from left to right.

The receiving space 28 has an insertion opening 29 and an end 30 in the direction R of movement, up to which the electronics module 14 can be inserted.

The bottom 24 delimits the receiving space 28 on its bottom side, i.e. on the side facing the glove 16.

The holder 20 further includes a guide 32 which specifies a movement path for the electronics module 14 during insertion into the holder 20.

The guide 32 has two guide walls 34 which are arranged laterally of the bottom 24 along the insertion direction R and extend at least partly from the bottom 24.

The guide walls 34 each have a bracket 36 formed thereon, which extends from the guide wall 34 toward the opposite guide wall 34. The brackets 36 delimit the receiving space 28 on the top side, i.e. the side facing away from the glove 16.

The brackets 36 extend from the end 30 of the receiving space 28, contrary to the direction R of movement.

In addition, the guide 32 includes a deflector 38 which extends from the bottom 24 into the receiving space 28.

In the embodiment shown, the deflector 38 is in the form of an edge which extends transversely to the insertion direction R, covering almost the entire width of the holder 20.

Of course, other configurations of the deflector are also conceivable, e.g. in the form of individual pins or grooves.

The deflector 38 is arranged between the mating contacts 26 and the end 30 of the receiving space 28 in the insertion direction R.

The height or level of the deflector 38 above the bottom 24 is selected here such that the mating contacts 26 are located entirely below an imaginary plane E which is defined by the highest point of the deflector 38 viewed from the bottom 24 and the straight line G on the bottom 24 at the end 30 of the receiving space 28. The mating contacts 26 are therefore located entirely between the imaginary plane E and the glove 16.

Moreover, terminating walls 39 are provided at the end 30 of the receiving space 28, which extend from the guide walls 34 transversely to the insertion direction R.

In addition, a lever 40 is provided on the front side of the holder 20 as viewed in the insertion direction R, the lever extending from the bottom 24 contrary to the insertion direction R. The lever 40 may be part of the guide 32.

The electronics module 14 is illustrated in FIGS. 3*a* to 3*c*. The electronics module 14 includes a housing 42 that defines a front side 44, a rear side 46, a bottom side 48, and a top side 50 of the electronics module 14.

A view of the bottom side 48 is illustrated in FIG. 3. The bottom side 48 is substantially flat, but, in the embodiment shown, it has a connecting region 52 which is offset from the rest of the bottom side 48 toward the top side 50. This is clearly apparent from FIG. 3*c*.

In the embodiment shown, the edge between the front side 44 and the bottom side 48 of the housing 42 is designed with a bevel.

Two contact elements 54 are provided in the connecting region 52 in the housing 42, which are thus arranged on the bottom side 48. They are flush with the housing 42, so that they do not offer any target surfaces that might be exposed to damage. In addition, a recess 56 formed as a groove extends in the connecting region 52 between the contact elements 54 and the rear side 46.

The recess 56 has a shape that is complementary to that of the deflector 38, so that the deflector 38 can almost fully engage into the recess 56. Furthermore, the recess 56 may extend transversely to the insertion direction R and almost over the entire width of the housing 42.

The recess 56 and the contact elements 54 are arranged and formed such that they correspond to the deflector 38 and the mating contacts 26 of the holder 20, respectively, when the electronics module 14 is attached in the holder 20.

In the embodiment shown, "transversely to the insertion direction" means parallel to the rear side 46.

The housing 42 furthermore includes indentations 58 extending from the rear side 46 on the top side 50 contrary to the insertion direction R. The indentations 58 are arranged at the sides of the top side 50 and at a distance from the bottom side 48 that corresponds to the distance of the brackets 36 of the holder 20 from the bottom 24 of the holder 20.

In the embodiment shown, the indentations 58 do not quite extend as far as to the recess 56.

Inside the housing 42, a circuit board 60 is provided which is attached by means of an elastic suspension 62 so as to be decoupled from the housing 42. For example, the circuit board 60 is clamped within the housing 42 by the elastic suspension 62. Moreover, further components may be provided in the housing 42, which are not illustrated in FIG. 3*c* for the sake of clarity. The further components will be discussed further below.

In the embodiment shown, the contact elements 54 are in the form of spring contacts and are firmly connected with the housing 42 and resilient in relation to the circuit board 60. In this way, the contact elements 54 are movably connected with the circuit board 60. It is, of course, also conceivable that the contact elements 54 are connected with the circuit board 60 by means of a flexible cable.

It is also conceivable that the contact element 54 and the mating contact 26 include antennas and a protective layer which protects the antennas against the outside.

Also, it is conceivable that the contact element 54 and the mating contact 26 are in the form of an inductive and/or capacitive contact device.

To this end, the mating contact 26, as a part of the inductive and/or capacitive contact device, may include an electrically conductive surface, the inductance and/or capacitance of which changes upon actuation of the electric operational element 18. The contact element 54, as a part of the inductive and/or capacitive contact device, may then include parts of a detection means which can detect the change in inductance and/or capacitance of the conductive surface of the mating contact 26.

The electrically conductive surface and/or the part of the detection means may be provided with a cover protecting them with respect to the holder 20 or the electronics module 14.

Figure 4A:
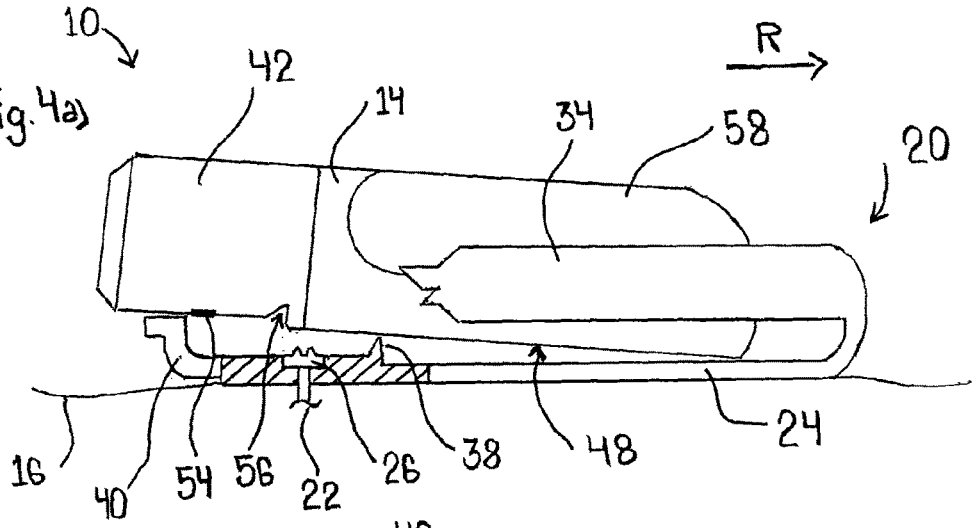
FIG. 4*a* schematically shows the wearable sensor system of FIG. 1 with the electronics module of FIG. 2 and the holder of FIG. 3 during insertion, in a first position of the electronics module.
Figure 4B:
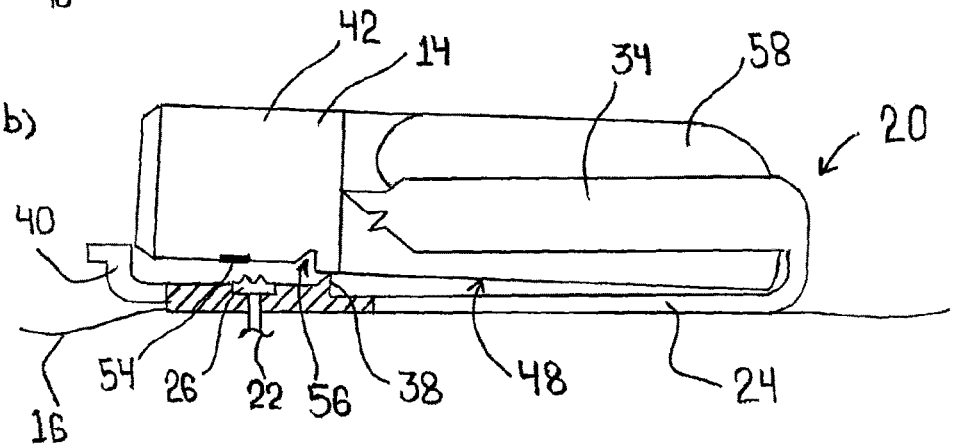
FIG. 4*b* schematically shows the electronics module and the holder of FIG. 4*a* as the insertion process continues, with the electronics module still in its first position.
Figure 4C:
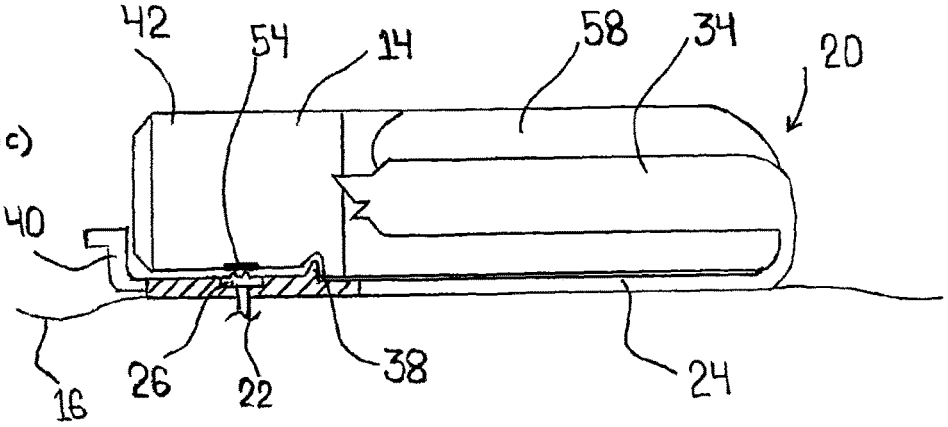
FIG. 4*c* schematically shows the electronics module in the second position, in which it is mounted in the holder.

In FIGS. 4*a* to 4*c*, different steps are shown during the process of insertion of the electronics module 14 into the holder 20 on the glove 16. For ease of understanding, the guide wall 34 has been drawn only in part.

FIG. 4*a* illustrates a first position during the insertion process. In this first position, the electronics module 14 has been partly introduced, with its rear side 46 first, through the insertion opening 29 into the receiving space 28.

For this purpose, at first the rear side 46 of the electronics module 14 was placed between the two guide walls 34 and then the electronics module 14 was positioned such that the lower sides of the indentations 58 engage under the brackets 36 of the holder 20.

The bottom side 48 of the electronics module 14 rests on the deflector 38 here, so that the contact elements 54 do not come into contact with any part of the holder 20 or the mating contacts 26 do not come into contact with the bottom side 48 of the electronics module 14. More specifically, the contact elements 54 are clearly spaced apart from the mating contacts 26.

This position is the first position of the electronics module 14.

The electronics module 14 is now moved in the insertion direction R, i.e. to the right with reference to the illustrations of FIG. 4; in the process, the electronics module 14 is introduced further into the receiving space 28.

With reference to FIG. 4, the electronics module 14 is guided by the guide walls 34 of the guide 32 in the horizontal direction and both by the brackets 36 and by the deflector 38 in the vertical direction, with the brackets 36 being slightly tensioned by the housing 42.

The bottom side 48 of the electronics module 14 travels over the deflector 38 here. In this way, the guide 32 prescribes a movement path of the electronics module 14.

The movement path runs substantially parallel to the insertion direction R here and thus substantially parallel to the bottom 24, until the position shown in FIG. 4*b* is reached. This position still corresponds to the first position of the electronics module 14, since the contact elements 54 of the electronics module 14 continue to be spaced apart from the holder 20, more particularly from the mating contacts 26.

The recess 56 of the electronics module 14 is now located directly in front of the deflector 38. Now when the electronics module 14 is moved just a short distance in the direction R of movement, the recess 56 and the deflector 38 will be positioned one above the other. At that moment, the electronics module 14 is moved toward the bottom 24 by the brackets 36, which had previously been prestressed by the distance between the bottom side 48 of the electronics module 14 and the bottom 24.

As a result, the contact elements 54, which are now located above the mating contacts 26, are also moved toward the bottom 24, that is, toward the mating contacts 26.

In the embodiment shown, this movement is a pivoting movement about a pivot axis G (FIG. 2*c*) at the end of the bottom 24, which at the same time defines the plane E.

It is also conceivable that the guide 32 is configured such that this movement is a linear movement, for example perpendicular to the bottom 24 and/or perpendicular to the direction R of movement.

The electronics module 14 has now reached the position shown in FIG. 4*c* and is in its second position. The contact elements 54 contact the mating contacts 26, and the electronics module is firmly held against the holder 20 by the brackets 36.

In the event that the contact element 54 and the mating contact 26 are in the form of antennas or an inductive and/or capacitive contact device having respective covers, the covers of the mating contact 26 and of the contact element 54 may contact in the second position.

The movement to the second position may also be regarded as a latching movement, the deflector 38 being introduced into the recess 56, so that the electronics module 14 latches in place on the holder 20. The latching process produces an audible noise, signaling to the user that the electronics module 14 has securely latched in place on the holder 20.

In the second position, the circuit board 60 is now connected to the electric operational element 18 in terms of information technology, in the illustrated embodiment electrically, via the contact elements 54, the mating contacts 26, and the cable 22.

To release the electronics module 14 from the holder 20, the lever 40 can be pushed toward the glove 16, whereby the latching connection is released in that the deflector 38 is guided out of the recess 56. The electronics module 14 can now be removed from the receiving space 28.

The electronics module 14 can, however, also be removed from the holder 20 in directions other than contrary to the insertion direction R. Above all, this increases the safety of the wearable sensor system 10.

For example, the electronics module 14 can also be removed upward. In doing so, the guide walls 34 are bent outward and the brackets are bent upward, as a result of which the electronics module 14 is removed from the holder 20. This serves to protect the user of the sensor system 10 if large forces act on the electronics module 14 which might cause damage to the hand of the user.

The electronics module 14 can, however, not be removed from the holder 20 in the insertion direction R since, in use, shocks regularly act on the electronics module 14 in the insertion direction R. This is prevented by the terminating walls 39.

Figure 5A:
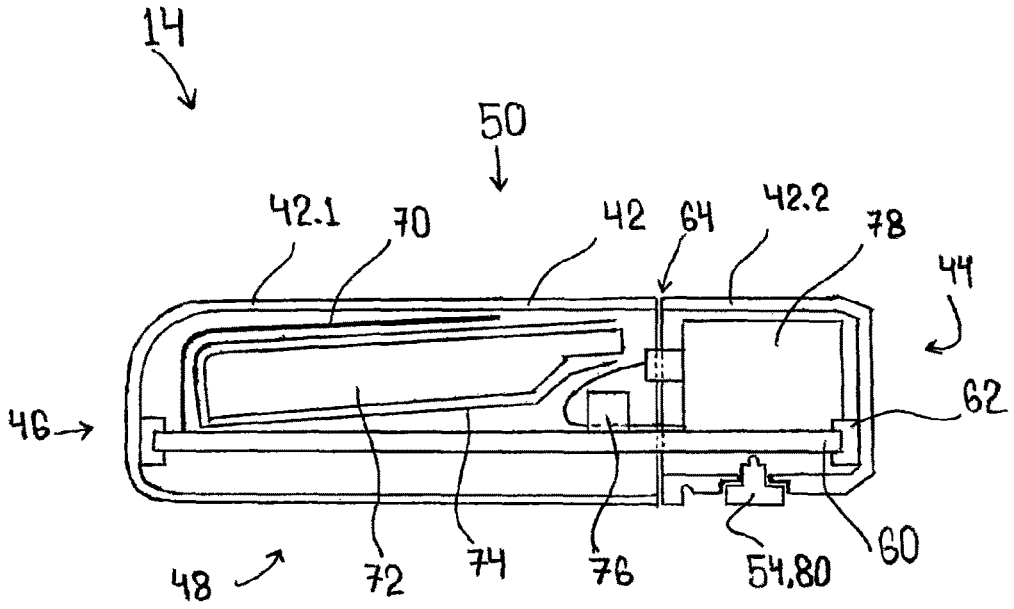
FIG. 5*a* schematically shows a sectional view of an embodiment of the electronics module according to the invention.
Figure 5B:
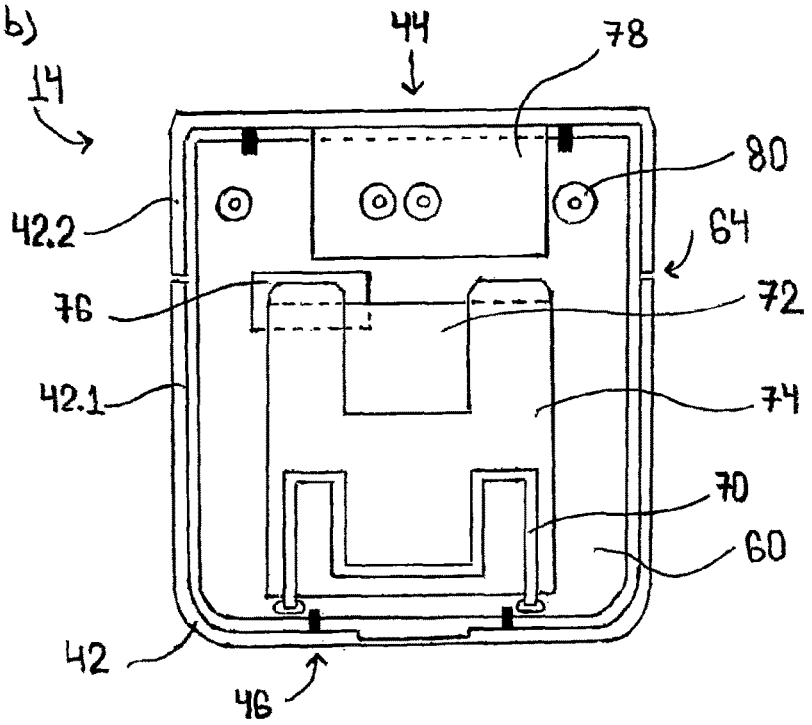
FIG. 5*b* schematically shows a top view of the electronics module of FIG. 5*a*, the top side of the housing not being illustrated.

FIGS. 5*a* and 5*b* illustrate an embodiment of the electronics module 14 in detail. The electronics module 14 as shown, more particularly the components used and the arrangement thereof within the housing, allows a particularly compact, in particular flat design.

This electronics module 14 allows wear on the wearable sensor system 10 to be still further reduced and the service life to be extended. However, the electronics module 14 and its details are also inventive on their own.

The housing 42 of the electronics module 14 includes two housing parts 42.1 and 42.2, each of which may be configured in one piece.

The rear housing part 42.1 comprises the rear side 46 of the housing 42 and parts of the top side 50 and of the bottom side 48, whereas the front housing part 42.2 comprises the front side 44 of the housing 42 and the remaining parts of the top side 50 and of the bottom side 48. The two housing parts 42.1 and 42.2 are connected with each other along a joint 64, for example by a plurality of screws.

The joint 64 therefore runs through the top side 50, the bottom side 48 and the longitudinal sides of the housing 42, as a result of which the length of the joint 64 is as small as possible. Since dust and moisture may enter through the joint of a housing, the short joint 64 reduces wear on the electronics module 14 as caused by dust or liquid and extends the service life.

Moreover, the short joint 64 renders it possible that only two screws are sufficient for a tight connection of the housing parts 42.1, 42.2. The holes drilled for the screws may start from the indentations 58 here.

In addition to the circuit board 60, an antenna 70, a battery 72, a battery casing 74, a vibration motor 76, and an optical detector 78 are provided inside the housing. In the embodiment shown, these components are arranged between the circuit board 60 and the top side 50.

The optical detector 78 is a barcode scanner, for example. However, the optical detector 78 and the vibration motor 76 may also be exchanged for or supplemented with other electronic components, or may be omitted, depending on the scope of functions of the electronics module 14 that is desired.

The optical detector 78, which is electrically connected to the circuit board 60, is arranged on the front side end of the circuit board 60.

The optical detector 78 is adapted to detect objects in front of the electronics module through openings in the front housing part 42.2.

But the front housing part 42.2 may also be made from a transparent material. This allows to dispense with openings in the front side 44 of the housing 42, leading to less dust and moisture entering the housing 42 and a longer useful life.

In the embodiment shown, the contact elements 54 are provided below the optical detector 78 and are tightly attached in the front housing part 42.2. Also, further contact elements 80 may be provided in the connecting region 52, by means of which the battery 72 can be charged.

The vibration motor 76 is mounted directly on the circuit board 60.

The antenna 70 is designed for frequencies below 1 GHz, more particularly for 915 MHz and/or 868 MHz, and may be manufactured from a thin steel, for example by cutting it out from a thin steel sheet. In this connection, thin means a thickness of less than 3 mm, more particularly of less than 1 mm.

The antenna 70 is arranged on the end of the circuit board 60 on the side of the rear wall and may be attached to the circuit board 60 by its two ends or by means of cables.

The antenna 70 extends, for example, along the rear side 46 and/or the top side 50 of the housing 42 toward the front side 44, the antenna 70 being pretensioned against the housing 42. For example, the antenna 70 is tensioned when it is inserted into the rear housing part 42.1. This allows as large a distance as possible to be obtained between the antenna 70 and the other electronic components, in particular the battery 72, as a result of which the transmission quality of the antenna 70 is improved.

It is also conceivable that the antenna 70 is integrated in the housing 42, in this case the rear housing part 42.1. This may be effected, for example, in that for manufacturing the housing part 42.1, 42.2, the antenna 70 is extrusion coated with the material of the respective housing part 42.1, 42.2.

The battery 72 is surrounded by a battery casing 74, for example on its rear, upper and lower sides, compensating for manufacturing tolerances and deformations of the battery 72.

Here, the battery casing 74 may rest on another component by its side facing away from the battery 72, for example the vibration motor 76, which allows installation space to be saved while the battery 72 is still protected from damage by this other component.

The battery casing 74 may be made from a strip of plastic material which is folded around the battery 72. The plastic material is preferably elastic and/or pretensioned toward the top side 50 of the housing 42.

Almost the entire space between the circuit board 60, the antenna 70 and the vibration motor 76 may be taken up by the battery 72 inclusive of the battery casing 74, allowing the use of as large a battery 72 as possible and, in this way, achieving long running times of the electronics module 14.

Accordingly, the antenna 70 is arranged partly between the battery casing 74 and the top side 50 of the housing 42. Due to its pretension, here the battery casing 74 may also act upon the antenna 70 with a force urging it toward the top side 50, so that the distance between the antenna 70 and the battery 72 is increased.

For assembly of the electronics module 14, the antenna 70, the battery 72, the battery casing 74, the vibration motor 76, the optical detector 78 and further electronic components that may be provided are arranged on and/or connected to the circuit board 60.

Then the housing parts 42.1 and 42.2 are slid around the circuit board 60 having the components mounted thereon, and the circuit board 60 is clamped in the housing parts 42.1, 42.2.

In the process, the circuit board 60 is contacted by the contact elements 54 attached in the first housing part 42.2. If the contact elements 54 are in the form of spring contacts, no soldering of the contact elements 54 and the circuit board 60 is required.

In addition, sections of the antenna 70 and/or of the battery casing 74 may be bent and thus tensioned when the rear housing part 42.1 is slid on toward the battery 72.

Subsequently, the two housing parts 42.1, 42.2 are screwed together.

The completed electronics module 14 may then be inserted into the holder 20 of an article of clothing 12 as described above. In this way, the operational element 18 is integrated into the circuit of the circuit board 60. If the operational element 18 is formed as a pushbutton, it can be used to activate, e.g., the optical detector 78.

The invention claimed is:

1. A wearable sensor system comprising an article of clothing and an electronics module, wherein said electronics module includes a housing defining a front side, a rear side, a bottom side and a top side of said electronics module, a circuit board provided in said housing, and at least one contact element which is electrically connected to said circuit board and is arranged at least partly on said bottom side, wherein said article of clothing includes a glove, an electric operational element, and a holder attached to said glove for repeatably attaching said electronics module to said glove without a tool, wherein said holder includes a receiving space for receiving said electronics module having an insertion opening and an end in said insertion direction (R), a bottom delimiting said receiving space with respect to said glove, at least one mating contact electrically connected to said operational element, and a guide, said at least one mating contact being provided at said bottom, wherein said electronics module is adapted to be inserted into said holder of said article of clothing such that said electronics module can assume two positions, said at least one contact element being spaced apart from said holder in the first position, and said at least one mating contact of said holder and said at least one contact element of said electronics module being in contact in the second position, so that said circuit board and said electric operational element are connected for information transfer by means of said at least one contact element and said at least one mating contact, and said guide being configured such that when attaching said electronics module to said holder, said electronics module travels along a predefined movement path in which said at least one contact element performs one of a linear movement and a pivoting movement toward said bottom when moving from said first position to said second position with respect to said at least one mating contact.

2. The wearable sensor system according to claim 1, wherein in said second position, said circuit board and said electric operational element are connected electrically by means of said at least one contact element and said at least one mating contact.

3. The wearable sensor system according to claim 1, wherein said guide includes at least one deflector which extends from said bottom into said receiving space.

4. The wearable sensor system according to claim 1, wherein said insertion direction (R) runs substantially parallel to said bottom.

5. The wearable sensor system according to claim 1, wherein in said second position, said electronics module has snapped into place in said holder.

6. An article of clothing for a wearable sensor system, comprising a glove, an electric operational element, and a holder attached to said glove for receiving said electronics module, wherein said holder includes a receiving space for receiving said electronics module having an insertion opening and an end in said insertion direction (R), a guide, a bottom, and at least one mating contact electrically connected to said operational element, wherein said bottom delimits said receiving space with respect to said glove, and said at least one mating contact is provided at said bottom, wherein said guide includes a deflector which extends from said bottom into said receiving space.

7. The article of clothing according to claim 6, wherein said at least one mating contact is arranged completely below an imaginary plane which is defined by said bottom at said end of said receiving space and said highest point of said deflector as viewed from said glove.

8. The article of clothing according to claim 6, wherein said at least one deflector is arranged between said at least one mating contact and said end of said receiving space in said insertion direction (R).

9. The article of clothing according to claim 6, wherein said guide includes at least one bracket which defines said receiving space on said top side.

10. The article of clothing according to claim 6, wherein said at least one bracket is arranged entirely between said at least one deflector and said end of said receiving space in said insertion direction (R).

11. The article of clothing according to claim 6, wherein said at least one mating contact is configured as a mechanical, electrical contact which is at least one of supported on said bottom and spring-mounted in relation to said bottom.

12. The article of clothing according to claim 6, wherein said holder includes a lever in said region of said insertion opening, for releasing said electronics module from said holder.

13. The electronics module for said wearable sensor system according to claim 1, comprising said housing defining said front side, said rear side, said bottom side and said top side of said electronics module, said circuit board provided in said housing, and said at least one contact element which is electrically connected to said circuit board for connecting with said at least one mating contact of said holder and which is arranged at least partly on said bottom side, said housing having one of a recess and a projection that cooperates with said guide of said holder such that when attaching said electronics module to said holder, said electronics module travels along a predefined movement path in which said at least one contact element performs one of a linear movement and a pivoting movement toward said bottom when moving from the first position to the second position with respect to said at least one mating contact.

14. The electronics module according to claim 13, wherein one of said recess and said projection is arranged between said contact element and said rear side.

15. The electronics module according to claim 13, wherein said recess is configured such that it can receive said deflector of said article of clothing.

16. The electronics module according to claim 13, wherein said recess is a groove that extends transversely to said insertion direction (R).

17. The electronics module according to claim 13, wherein said at least one contact element is offset from said bottom side toward said top side.

18. The electronics module according to claim 13, wherein said at least one contact element is a mechanical, electrical contact which is fixedly connected to said housing and movably connected to said circuit board.

19. The electronics module according to claim 13, wherein said housing has at least one indentation which extends from said rear side at least partly on said top side.

* * * * *